United States Patent [19]

Tanabe et al.

[11] 4,359,711

[45] Nov. 16, 1982

[54] ROTARY VARIABLE RESISTOR

[75] Inventors: Hirokuni Tanabe, Miyagi; Masahiro Onodera, Furukawa, both of Japan

[73] Assignee: Alps Electric Co., Ltd., Tokyo, Japan

[21] Appl. No.: 274,759

[22] Filed: Jun. 18, 1981

[30] Foreign Application Priority Data

Jun. 23, 1980 [JP] Japan ..... 55-87763[U]

[51] Int. Cl.[3] ..... H01C 10/16

[52] U.S. Cl. ..... 338/134; 338/123

[58] Field of Search ..... 338/134, 123, 124, 128, 338/129

[56] References Cited

U.S. PATENT DOCUMENTS 2,493,184 1/1950 Budd et al. ..... 338/134

2,941,175 6/1960 Zarrillo ..... 338/134

3,611,245 10/1971 Puerner ..... 338/134

FOREIGN PATENT DOCUMENTS 56-145807 11/1981 Japan .

*Primary Examiner*—C. L. Albritton

*Attorney, Agent, or Firm*—Guy W. Shoup; Gerard F. Dunne

[57] ABSTRACT

In a rotary variable resistor wherein variable resistors which are operated by inner and outer shafts independently of each other are received in a single case; an unrotatable plate member having both its surfaces smoothed is interposed between the inner and outer shafts so as to prevent these shafts from turning together undesirably.

3 Claims, 3 Drawing Figures

ROTARY VARIABLE RESISTOR

BACKGROUND OF THE INVENTION

The present invention relates to a rotary variable resistors of the type wherein separate sliders are actuated independently by an inner shaft and an outer shaft, and more particularly, to an improved resistor which prevents the outer shaft and the inner shaft from turning simultaneously.

Conventional variable resistors of the type having two shafts typically have the multistage construction in which a slider to be actuated by an outer shaft is received in a case of a preceding stage, while a slider to be actuated by an inner shaft is received in a case of a succeeding stage. Such construction has involved numerous disadvantages in that the number of components is large, that the assemblage is complicated, that the cost is high and that the space in the depth direction becomes large.

In order to eliminate the disadvantages, the inventors of the present invention have proposed in Japanese Utility Model Application No. 55-44450 (1980) a two-shaft type variable resistor of simplified structure in which variable resistors to be actuated independently by inner and outer shafts are received within a single case.

The variable resistor described in the pending application is compact and is easy to fabricate. However, it has the disadvantage that the inner and outer shafts sometimes turn together.

SUMMARY OF THE INVENTION

The present invention has been made in view of the above disadvantage, and has for its object to provide a two-shaft type rotary variable resistor which prevents the inner and outer shafts from turning simultaneously.

According to one aspect of performance of the present invention, inner and outer shafts are operatively separated by a non-rotatable plate member having smooth surfaces and interposed therebetween.

PREFERRED EMBODIMENT OF THE INVENTION

Figure 1:
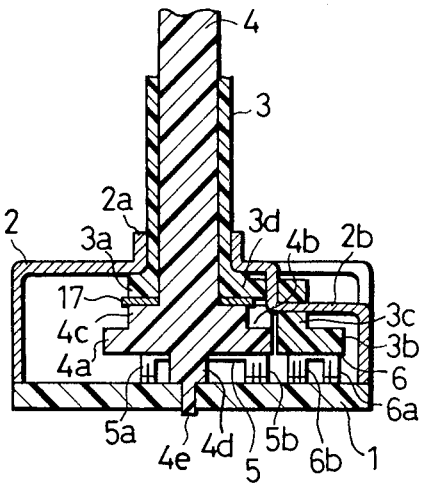
FIG. 1 is a side sectional view of a rotary variable resistor embodying the present invention as depicted in its assembled state.

Hereunder, the present invention will be described in detail in conjunction with an embodiment shown in FIGS. 1 to 3.

Referring to the figures, numeral 1 designates an insulating substrate, to which a cap-like metallic case 2 is fixed by caulking or the like. A cylindrical bearing portion 2a is protrusively provided in the central part of the top surface of the case 2. A portion 2b is bent inwardly in a manner to extend from the top surface of the case 2 to the side periphery thereof, and it functions as a stopper, as will be described.

Numeral 3 indicates a hollow outer shaft which is made of an insulating synthetic resin and which is rotatably carried by the bearing portion 2a of the case 2. As shown in FIG. 3, the outer shaft 3 has its end part provided with a flange 3a which serves to hold the outer shaft within the case 2. Further, it is integrally formed with an arm 3d which extends radially outwards from the flange 3a, a stopper 3c which is suspended from an end part of the arm 3d, and a slider carrier 3b which extends from the lower end of the stopper 3c. A slider 6 which lies in resilient contact with the insulating substrate 1 is riveted to the lower surface of the slider carrier 3b. A vacant space 3e is defined underneath the arm 3d, and allows a stopper projection 4b of an inner shaft 4 to pass therethrough.

The inner shaft 4 is made of an insulating synthetic resin, and is rotatably embraced by the outer shaft 3. The lower end part 4e of the inner shaft 4 is inserted in a central aperture 1b of the insulating substrate 1 (refer to FIG. 2). Over the lower end part 4e, there are integrally formed a spacer 4d, a slider carrier 4a, the stopper projection 4b and a flange 4c (refer to FIG. 3). A slider 5 is riveted to the lower surface of the slider carrier 4a, and is held in resilient contact with the insulating substrate 1.

Figure 2:
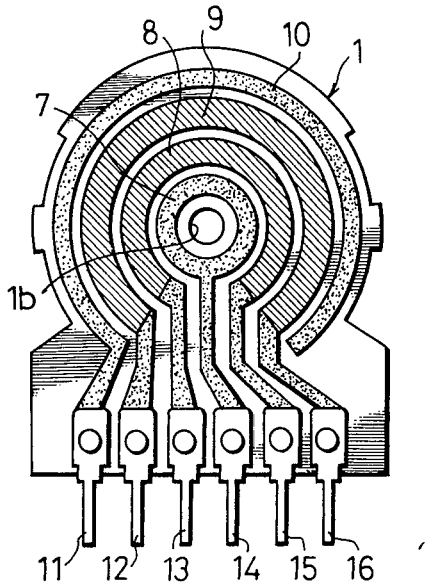
FIG. 2 is a top plan view of an insulating substrate in the emodiment.
Figure 3:
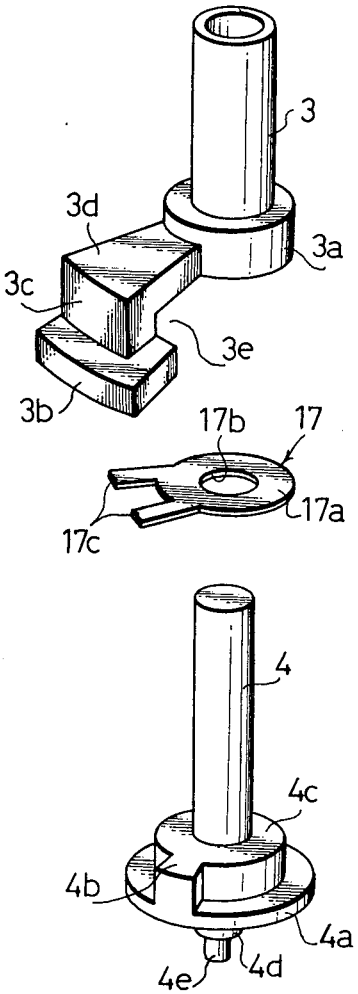
FIG. 3 is an exploded perspective view of the essential portions of the embodiment.

As shown in FIG. 2, a first collector 7, a first resistor 8, a second resistor 9 and a second collector 10 are printed and formed on the upper surface of the insulating substrate 1 around the central aperture 1b and concentrically therewith in a manner to be successive from the innermost. Shown at numerals 11 to 16 are terminals which are connected to the collectors and the resistors.

Numeral 17 denotes a ring-shaped plate member which is formed of a metal sheet or resin sheet and both the surfaces of which are made quite smooth. As shown in FIG. 3, it consists of an annular portion 17a the central part of which is provided with a hole 17b for inserting the inner shaft 4 therethrough, and a pair of engaging pieces 17c and 17c which extend outwardly from the outer periphery of the annular portion 17a. Under the unrotatable state under which the engaging pieces 17c and 17c hold the bent portion 2b of the case 2 therebetween, the plate member 17 has the annular portion 17a sandwiched between the flange 4c of the inner shaft 4 and the flange 3a of the outer shaft 3.

In assemblage, before the insulating substrate 1 is mounted on the open side of the case 2, the hollow outer shaft 3 with the slider 6 attached to the slider carrier 3b is inserted from the open side into the bearing portion 2a of the case 2. Subsequently, the plate member 17 is arranged on the flange 4c by inserting the inner shaft 4 through the hole 17b. Thereafter, the inner shaft 4 with the slider 5 fixed to the slider carrier 4a is inserted through the hollow of the outer shaft 3, and the bend portion 2b of the case 2 is held between the engaging pieces 17c and 17c of the plate member 17. When the upper surface of the flange 4c of the inner shaft 4 and the lower surface of the flange 3a of the outer shaft 3 are placed one over the other with the plate member 17 interposed therebetween, the slider carrier 3b of the outer shaft is juxtaposed outside the slider carrier 4a of the inner shaft and in a manner to be even therewith. Under this state, the lower end part 4e of the inner shaft 4 is inserted through the central aperture 1b of the insulating substrate 1 having the terminals 11 to 16 mounted thereon, and a plurality of mounting legs (not shown) formed at the lower end of the case 2 are fixed to the insulating substrate 1 by caulking. Then, one contact piece 5a of the slider 5 comes into resilient contact with the first collector 7 and the other contact pulse 5b with the first resistor 8, while one contact piece 6a of the slider 6 comes into resilient contact with the second collector 10 and the other contact piece **6*b* with the second resistor 9. By rotating the outer shaft 3 and the inner shaft 4 independently of each other, the contact pieces are slid on the corresponding resistors and collectors in accordance with the rotation of the repective shaft, and they vary respective resistance values within rotatable ranges controlled by the bent portion 2*b*** as the stopper.

Since, in this case, the non-rotatable plate member 17 having the smooth surfaces intervenes between the inner shaft 4 and the outer shaft 3, the tendency for these shafts 3 and 4 to rotate simultaneously is considerably reduced.

As described above in detail, according to the present invention, in the rotary variable resistor is compact and easy to fabricate, and the two variable resistors which are independently operated by the outer shaft 3 and the inner shaft 4 are received in the single case 2, and yet the simultaneous turning of the outer shaft 3 and the inner shaft 4 can be reliably prevented, which is greatly valuable in practical use.

We claim:

1. In a rotary variable resistor having two concentric shafts including a first outer shaft carrying a first slider outwardly of its lower end portion, and an inner shaft extending through said outer shaft and carrying on its lower portion a second slider adapted to pass between said outer shaft and said first slider during rotation of either of said shafts, the improvement including a plate member held between respective flange portions formed on the lower portion of said outer and inner shafts and means engaging said plate member for preventing it from rotating whenever either of said shafts is rotated to prevent such rotation being transmitted to the other shaft.

2. A rotary variable resistor as in claim 1, including a casing for housing said variable resistor, said means including two engaging pieces extending outwardly from said plate member and adapted to straddle a stop member held to the casing of the resistor.

3. A rotary variable resistor according to either claim 1 or 2, said plate member having smooth surfaces engaging said respective flange portions.

* * * * *